US006131776A

United States Patent [19]

De Laforcade et al.

[11] Patent Number: 6,131,776

[45] Date of Patent: Oct. 17, 2000

[54] PACKAGING AND PRESSURIZED DISPENSING ASSEMBLY WITH EXTEMPORANEOUS PRESSURIZATION

[75] Inventors: Vincent De Laforcade, Rambouillet; Pierre-Andre Lasserre, Coubron, both of France

[73] Assignee: L'Oreal, Paris, France

[21] Appl. No.: 09/231,872

[22] Filed: Jan. 14, 1999

[30] Foreign Application Priority Data

Jan. 14, 1998 [FR] France ..... 98 00315

[51] Int. Cl.[7] ..... B67D 5/42

[52] U.S. Cl. ..... 222/387; 222/389; 222/399; 222/496

[58] Field of Search ..... 222/387–389, 222/399, 496

[56] References Cited

U.S. PATENT DOCUMENTS

| | | | |
|---|---|---|---|
| 3,788,525 | 1/1974 | Thornton et al. . | |
| 4,197,884 | 4/1980 | Maran . | |
| 5,133,701 | 7/1992 | Han | 222/389 X |
| 5,522,526 | 6/1996 | DeLaforcade et al. | 222/389 X |

FOREIGN PATENT DOCUMENTS

| | | | |
|---|---|---|---|
| 757 134 | 4/1971 | Belgium . | |
| 0 642 839 A1 | 3/1995 | European Pat. Off. . | |
| 2 246 468 | 5/1975 | France . | |
| 0384691 | 2/1990 | United Kingdom | 222/387 |

*Primary Examiner*—Kevin Shaver
*Assistant Examiner*—Thach Bui
*Attorney, Agent, or Firm*—Oblon, Spivak, McClelland, Maier & Neustadt, P.C.

[57] ABSTRACT

An assembly for packaging and pressurized dispensing of a product, particularly a cosmetic, including a first container which is surmounted by a first valve capable of moving from a closed position to an open position for dispensing the product, and which defines two compartments which are separated in a leaktight manner by a movable piston. The first compartment contains the product and the second compartment receives a propellent gas capable of pressurizing the product via the movable piston. When the valve is in a closed position, the second compartment is substantially at atmospheric pressure.

20 Claims, 3 Drawing Sheets

PACKAGING AND PRESSURIZED DISPENSING ASSEMBLY WITH EXTEMPORANEOUS PRESSURIZATION

BACKGROUND OF THE INVENTION

Field of the Invention

The present application relates to an assembly for packaging and dispensing a product under pressure, and in particular a cosmetic product. The invention is most particularly adapted for the packaging and dispensing under pressure, certain hair-care products, Such as dye products, and particularly tone-on-tone dye.

There are in existence so-called "tone-on-tone" oxidation dyes which are packaged in cans containing an aluminum pouch delimiting two volumes which are separate from each other. The pouch includes a first volume communicating with a dispensing head and containing the dye, and a second volume containing a propellent gas, particularly butane 3.2. Products of this type are very sensitive to light and oxygen. At the time of use, the dye is mixed with an oxidizing cream packaged in a separate can. Apart from the lack of reliability, packaging of this type is extremely expensive.

With a view to producing a more economical assembly, there have been developed piston-type cans, or cans with another separation means, comprising a can surmounted by a value and by a dispensing head. In these types of containers, the product is pressurized by means of a propellent gas kept separate from the product by the movement of a piston sliding in the can in substantially a leaktight manner, or by other movable separation barrier means. In the case of the piston can, the seal is conventionally provided by an O-ring arranged at the periphery of the piston and by a scraper lip bearing tightly against the inner walls of the can. Despite all these precautions to ensure the piston has a good seal, this seal has not proved to be satisfactory. Indeed, as the can is extruded, its inner face presents longitudinal microgrooves which are sufficient to allow a slow diffusion of the propellent gas into the other compartment containing the product. Thus, over time, and through the action of the gaseous pressure and osmotic pressure, the propellent butane diffuses along the piston and dissolves in the formula, until the pressures are equalized.

When the user wishes to use the contents of the can, restoring the product to atmospheric pressure gives rise to a bubbling-up of the dissolved gases and "foaming" of the formula, which is very badly perceived by consumers who may be led to believe that the product is defective.

EP-A-0,642,839 describes a device for dispensing and packaging a fluid product contained in a pressurized container with the aid of a propellent gas contained in a compartment of the container, separate from the product to be dispensed via a piston. The container is surmounted by a manually actuated valve. Between two uses, the compartment containing the propellent gas is emptied of gas by means of a microslot so that, after a certain period of time, the compartment is at atmospheric pressure. According to that document, opening and closing of the valve for dispensing the product are brought about by means of an actuating mechanism in the form of a push-button controlled independently of the pressure inside the compartment containing the propellent gas. A design of this type increases the amount of handling needed at the time of use.

Therefore, one of the objects of the invention is to propose an assembly for packaging and dispensing a product of the type referred to above which does not have the drawbacks discussed in the aforesaid with regard to conventional devices.

A particular object of the invention is to provide a reliable, economical assembly which keeps the product completely separate from the propellent gas throughout the product's life.

Further objects of the invention will become apparent in a detailed manner from the following description.

SUMMARY OF THE INVENTION

These objects are achieved by means of an assembly for packaging and dispensing a product under pressure, such as a cosmetic. The assembly includes a first container, surmounted by a first valve capable of moving from a closed position to an open position for dispensing the product. The container defines two compartments which are kept separate from each other in a substantially leaktight manner, particularly by means of a movable seal, preferably in the form of a moveable piston. The assembly also includes a first compartment containing the product and a second compartment for receiving a propellent gas capable of pressurizing the product via the movable piston, the second compartment being, in the closed position of the first valve, substantially at atmospheric pressure, wherein opening and/or closing of the first valve is controlled by the pressure inside the second compartment.

Thus, by means of this extemporaneous pressurization, i.e. only during those periods when product is dispensed, there is no longer any substantial diffusion of the propellent gas into the formula. The formula is substantially free of any dissolved gas and consequently does not foam upon exit from the device.

Thus, closure of the first valve may be caused by the changeover of the second compartment to atmospheric pressure. On this assumption, upon closure, interruption of the actuation command gives rise, firstly, to the second compartment being placed at atmospheric pressure, and, secondly, closure of the said first valve. Similarly, upon opening, a single actuation command may give rise, firstly, to extemporaneous pressurization of the product and, secondly, opening of the First valve. Both opening and closure of the first valve are preferably controlled by the pressure prevailing inside the second compartment. The handling operation is simple since, both upon opening and upon closure, a single handling operation suffices firstly to pressurize the second compartment and secondly to cause opening of the first valve, respectively, on the one hand to depressurize the second compartment and on the other hand to cause closure of the first valve.

Although the movable piston constitutes the preferred separation means, other means, particularly a flexible pouch, may be used as a separation barrier to separate the product from the propellent gas.

Advantageously, the propellent gas is contained under pressure in a second container capable of being placed selectively in communication with the first in order to pressurize the second compartment for dispensing the product under pressure, means being provided for interrupting communication between the first container and the second and for placing the second compartment at atmospheric pressure between uses when the first valve is in the closed position.

Preferably, the second container is surmounted by a second valve capable of moving from a closed position to an open position. The second valve is also preferably connected to an exit channel which, in the open position of the said second valve, is in leaktight communication with the second compartment via an inlet orifice of the said second compartment so as to allow the passage of the propellent gas from the second container towards the second compartment of the first container. The inlet orifice is preferably in communication with the outside when the second valve is in the closed position, so as to place the second compartment at atmospheric pressure.

Advantageously, the leaktight communication is produced by means of a preferably flexible coupling element surmounting the exit channel and intended for sealing in a leaktight manner, around the inlet orifice when a pressure is exerted on an end of the second container opposite the said second valve. The leaktight seal preferably ceases when the second valve moves into the closed position by means of elastic return. By way of example, the coupling element may be produced from elastomeric material.

The inlet orifice is preferably made in the base of the first container, where means are provided for holding the second container in a predetermined position with respect to the first. A stand-alone assembly is thus produced, which is easy to handle and ready for use without any preliminary handling operations.

Holding means for holding the second container in a predetermined position may include a sleeve which is integral with the first container and of which one end located opposite the end of the second container that is opposite the said second valve, is at least partially open, the second container being mounted slidably inside the sleeve over a path which is at least equal to the actuation height of the second valve. The play existing between the inner walls of the sleeve and the second container provides sufficient space, upon rupture of the seal between the first container and the second, to allow the gas contained in the second compartment to escape, via the open end of the sleeve, thereby making it possible to place the second compartment at atmospheric pressure.

By way of example, the said sleeve is rendered integral with the first container by self-closing fitting, snap-fitting, adhesive bonding or welding. A fitting of this type may be removable, particularly to restrict overall size in the storage position or, if appropriate, to enable the second container to be refilled with propellent gas.

Advantageously, the first valve moves into the open position when the pressure inside the first compartment, through the action of the propellent gas, reaches a predetermined value. When the pressure inside the first compartment drops below the said predetermined value, the first valve moves into the closed position, through the action of elastic return means. The first valve may be a ball type valve.

As mentioned above, it is possible for the said second container to be removable and/or to be refillable with propellent gas. Indeed, it may be sold as a reusable accessory for emptying a number of packages sold separately. Moreover, provision may be made for the second container to contain an amount of gas only sufficient to discharge just a fraction of the contents of the first. Indeed, in the case of a product which has to be dispensed in a metered fashion, the second container may advantageously contain the amount of propellant necessary for dispensing one metered amount of product.

According to a preferred embodiment, the second container comprises a body and a base, the body forming a valve-support dish for the second valve. Furthermore, the body in configured to interact with the base to form, firstly, a reservoir for the said propellent gas and, secondly, the valve body for the said second valve. A configuration of this type makes it possible, at a reasonable cost price, not to significantly increase the size of the assembly compared with conventional devices in which the product and the propellent gas are contained in the same can.

The product may be a hair-care product, particularly an oxidation dye.

BRIEF DESCRIPTION OF THE DRAWINGS

Apart from the arrangements set forth above, the invention consists in a number of other arrangements which will be explained below, by way of nonlimiting illustrative embodiments, described with reference to the attached drawings, among which:

in FIG. 1A, the assembly is in the closed position; in FIG. 1B, the assembly is in the dispensing position;

DETAILED DESCRIPTION OF THE PREFERRED EMBODIMENTS

Figure 1A:
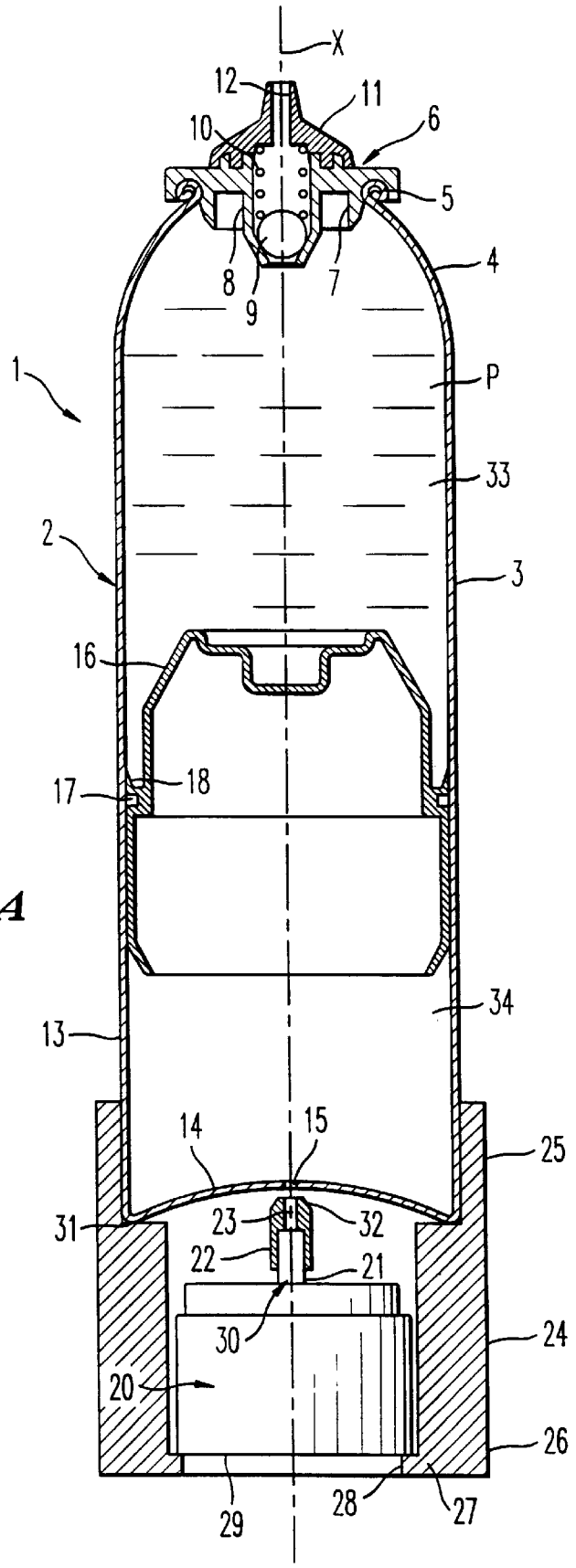
FIGS. 1A and 1B are sectional views of a preferred embodiment of the assembly according to the invention.
Figure 1B:
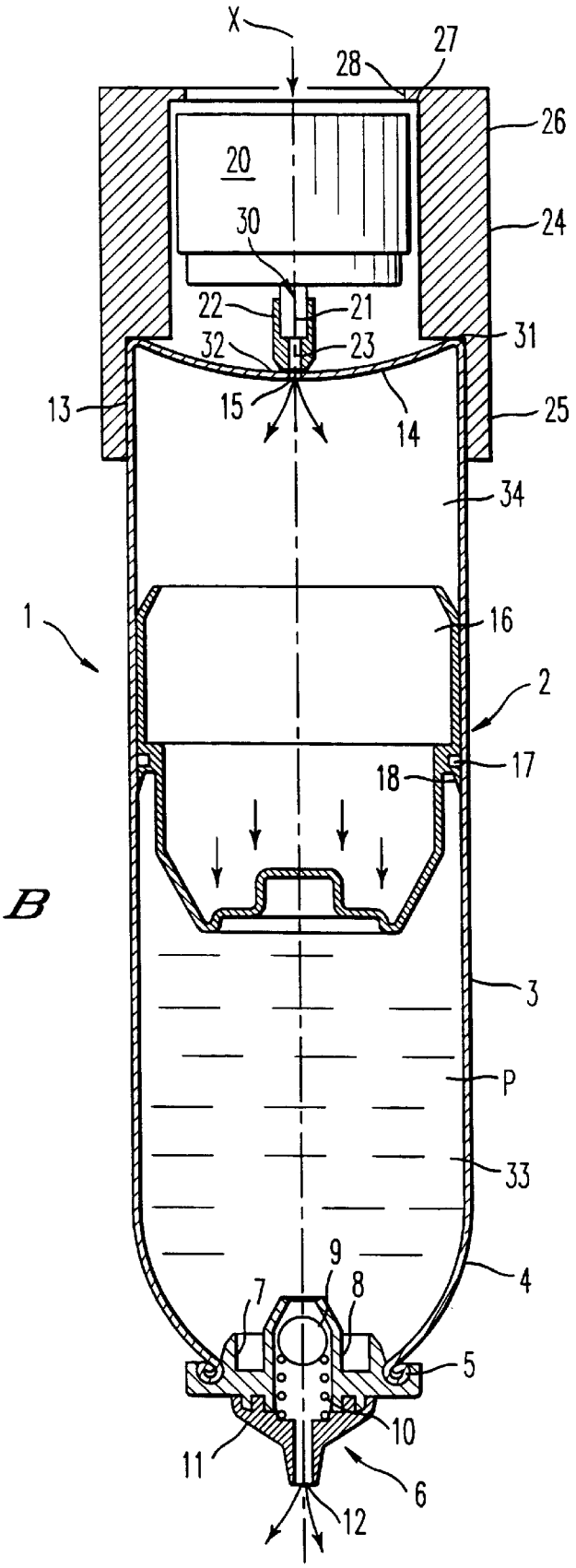

As shown in FIGS. 1A and 1B, the assembly 1 for packaging and dispensing under pressure, principally includes a can 2 with a longitudinal axis X, for example made from aluminum which is varnished on its inner face. The can has a body 3 forming a first container of generally cylindrical section, a first end 4 of which forms a shoulder, ending in an opening delimited by a crimped rolled edge 5 on which a valve 6 is mounted, particularly by means of snap-fitting.

The valve 6 has a scaling skirt 7 capable of interacting in a leaktight manner with the edges delimiting the opening of the can 2. The valve includes a central shaft delimiting an axial channel 8 inside which a ball 9, with a diameter which is less than the internal diameter of the axial channel 8, is arranged, so that the product is able to flow between the ball 9 and the walls of the axial channel 8. However, the lower end of the axial channel 8 has a frustoconical section which is smaller than the diameter of the ball 9 so as to form a seat for the ball. Thus, when the ball rests on the frustoconical portion, held in elastic return by means of a spring 10, it closes off the axial channel 8 in a leaktight manner. The end of the central shaft, opposite the frustoconical part, delimits an opening closed off by a component 11 forming an exit channel 12. Thus, the spring is held up against the ball 9 on the one hand and against the component 11 on the other hand, the component 11 being mounted on the valve 6 by snap-fitting. Thus, as long as the pressure inside the can is lower than the force of the spring 10, the ball 9 bears on its seat in a leaktight manner, thus preventing the product from exiting. As soon as the pressure increases and exceeds the force of the spring 10, the ball 9 is lifted from its seat and rises in the axial channel. At this moment, the pressurized product (P) can flow between the ball 9 and the inner walls of the axial channel 8.

A second end 13 of the can 2 is closed by a base 14 which is provided, in approximately its centre, with an orifice 15, the function of which will be detailed below.

A piston 16, mounted slidably and bearing on the inner walls of the can 2 in a substantially leaktight manner, is arranged inside the can. The piston delimits a first compartment or upper volume 33 containing the product (P) and a second compartment or lower volume 34 intended for receiving the propellent gas. The seal around the piston 16 is provided by an O-ring 17, such as a scraper lip 18. The profile of the piston 16 is chosen appropriately so as to optimize the degree to which the can 2 is emptied. For example, the upper end of piston 16 is contoured to complement the lower end of valve 6 so as to minimize the volume of upper volume 33 when piston 16 is located at its uppermost position, adjacent valve 6.

The product (P) to be dispensed is contained in the upper volume 33 of the can 2, between the piston 16 and the valve 6. For filling the can 2, the piston is arranged in the low position. The liquid is introduced via the opening delimited by the crimped rolled edge 5. Valve 6 is then snap-fitted onto the can 2.

The assembly illustrated according to this embodiment comprises a second container 20, located under the first container and containing a pressurized gas. Container 20 is surmounted by a rod 21 emerging from a penetration valve 30 biased towards the closed position by an elastic return (not shown). A flexible connector 22, delimiting a channel 23 and a free end 32 of which is arranged opposite orifice 15 provided in base 14 of the can 2, is mounted on the valve rod 21. Container 20 is held in position by sleeve 24, a first end 25 of which is forcibly or slip-fitted over the end 13 of the can 2. A shoulder 31 restricts the depth of penetration of the can 2 into the sleeve 24. A second end 26 of the sleeve 24 has an annular rim 27 with an internal diameter which is smaller than the external diameter of the container 20, so as to hold the latter. The rim 27 delimits an opening 28 providing access to the base 29 of the container 20. The internal diameter of the sleeve 24 is slightly greater than the external diameter of the container 20 so that the latter is able to slide freely inside, over a height which is at least equal to the actuation height of the valve rod 21. Thus, in the rest position illustrated in FIG. 1A, the base 29 of the container 20 rests on the rim 27 of the sleeve 24. The axial height of the sleeve 24 is sufficient so that, in this position, the valve 30 is in the closed position and the free end 32 of the flexible connector 22 does not bear in a leaktight manner all around the orifice 15 so that, in this position, the second compartment 34 of the can located under the piston 16 is substantially at atmospheric pressure.

To dispense a metered amount of product, the user turns the assembly 1 upside down, placing a finger on the base 29 of the container 20, through the opening 28. The user presses gently on the base 29 of the container 20. This pressure causes a displacement of the container 20 in the sleeve 24 so that the end 32 of the flexible connector 22 connects in a leaktight manner with orifice 15 of the can 2. By continuing to exert pressure on the base 29, the user causes penetration of the valve rod 21 and opening of the valve 30. The propellent gas exits under pressure via the emerging rod 21, passes into the flexible connector 22 and enters the lower volume 34 of the can 2, via orifice 15. The propellent gas expands and then fills the lower volume 34 located under the piston 16. The internal pressure is transmitted to the product (P) and increases until it is sufficient to detach ball 9 from its seat. At this moment, the product (P) flows via the exit channel 12. This dispensing position is shown in FIG. 1B. As soon as the required metered amount has been dispensed, the user relaxes the pressure on the base of the container 20, which, through elastic return, causes the valve rod 21 to rise, as viewed in FIG. 1B, and the valve 30 to close. Closure of the valve 30 also causes rupture of the leaktight connection between the orifice 15 and the flexible connector 22 is produced by the pressure exerted on the base by the user. Accordingly, base 29 returns to a position against the rim 27 of the sleeve 24. At this moment, the propellent gas escapes from the lower volume 34 via the orifice and flows between the walls of the container 20 and the inner walls of the sleeve 24. The pressure exerted by the piston 16 then becomes insufficient to hold the valve 6 open. Ball 9 therefore returns to bear in a leaktight manner on its seat, thereby interrupting the dispensing of the product. The lower volume 34 then returns to substantially atmospheric pressure.

Thus, between uses, there is no passage of gas along the walls of the piston. The formula retains its clear appearance. The amount of propellent gas contained in the container 20 may be chosen so as to be sufficient to empty the entire can 2. Alternatively, provision may be made for the container 20 to be replaced when it is empty, at which time it is replaced by another, full container. Alternatively, provision may be made to refill the container 20, either by its upper valve or via an auxiliary orifice made, for example, in the base of the container 20.

Figure 2:
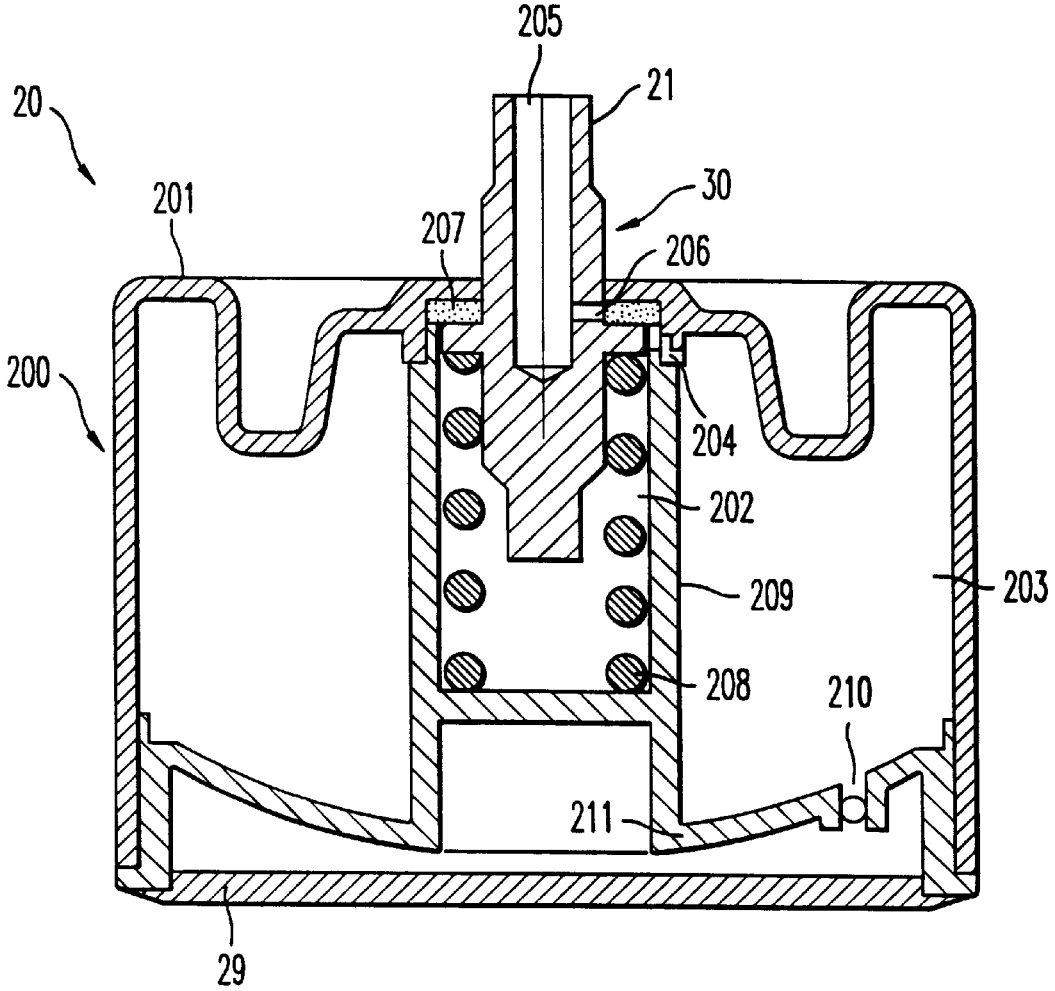
FIG. 2 is a sectional view, in greater detail, an embodiment of a container which may be used to package the propellent gas.

By way of illustration, FIG. 2 shows, in greater detail, an embodiment of a container 20 which may be used advantageously in the assembly according to the invention. A container 20 of this type principally comprises a body 200 of which an end wall forms a dish 201 for the valve 30. The end of the body opposite the valve-support dish is closed off by a base 211 which also forms an axial shaft 209 defining a valve body 202 for the valve 30. The base 211 may be welded, snap-fitted or screwed onto the body 200. Thus, the body 200 and the base 211 define, firstly, a reservoir 203 for the propellent gas and, secondly, a valve body 202. The reservoir 203 and the valve body are in communication via a passage 204. The valve rod 21 has a first end emerging from the valve body 202, traversed by an axial channel 205 emerging laterally on the valve rod, via a passage 206, substantially at mid-height of the rod, and a second end located inside the valve body, the second end being mounted on a spring 208 so as to hold the passage 204, by means of elastic return, opposite a leaktight seal 207, thereby biasing the valve toward the closed position. A filling orifice 210, closed off by a ball valve, is provided in the base 211 of the container 20. An attached, removable base 29 is provided so as to define a planar bearing surface. The container 20 is obtained entirely by moulding a thermoplastic material. A more detailed description of a container of this type is given in Patent FR 2,741,047, in the name of the Applicant, which is hereby expressly incorporated by reference.

In the above detailed description, reference has been made to preferred embodiments of the invention. Obviously, changes may be made thereto without departing from the spirit of the invention as claimed below. This application is based on French Patent Application No. 980035, filed on Jan. 14, 1998, the entire contents of which are hereby expressly incorporated by reference.

What is claimed as new and desired to be secured by Letters Patent of the United States is:

1. An assembly for packaging and dispensing a product, comprising:

a first container;

a first valve provided on said first container, said first valve configured to move from a closed position to an open position for dispensing the product;

first and second compartments both defined in said first container; and a partition member provided in said first container configured to separate said first and second compartments, said partition member forming a substantially leaktight seal between said first and second compartments;

said first compartment configured to receive the product to be dispensed, and said second compartment configured to receive a propellant gas capable of pressurizing the product via said partition member, said first valve configured such that movement of said first valve between said open position and said closed position is controlled by a pressure inside said second compartment; and wherein when said first valve is in said closed position, said second compartment is substantially at atmospheric pressure.

2. The assembly according to claim 1, wherein said partition member comprises separation means.

3. The assembly according to claim 1, wherein said partition member comprises a piston.

4. The assembly according to claim 1, wherein said first valve is configured such that movement of said first valve to said closed position is caused by when a pressure in said second compartment changes from a pressure greater than atmospheric pressure to a pressure substantially equal to atmospheric pressure.

5. The assembly according to claim 1, further comprising:

a second container containing the propellent gas under pressure, said second container configured to selectively communicate with said first container so as to pressurize said second compartment and thereby dispense the product under pressure through said first valve; and release means for interrupting communication between said first container and said second container and for placing said second compartment substantially at atmospheric pressure when said first valve is in said closed position.

6. The assembly according to claim 4, further comprising:

a second container containing the propellent gas under pressure, said second container configured to selectively communicate with said first container so as to pressurize said second compartment and thereby dispense the product under pressure through said first valve; and release means for interrupting communication between said first container and said second container and for placing said second compartment substantially at atmospheric pressure when said first valve is in said closed position.

7. The assembly according to claim 5, further comprising:

an inlet orifice provided on said second compartment;

a second valve provided on a first end of said second container, said second valve configured to move between a closed position and an open position, said second valve configured such that when said second valve is in said open position, said second valve is in leaktight communication with said second compartment via said inlet orifice, so as to allow passage of propellant gas from said second container into said second compartment of said first container; and an exit channel connected to said second valve, said exit channel configured so as to allow said inlet orifice to communicate with an outside of said assembly when said second valve is in said closed position, so as to thereby place said second compartment substantially at atmospheric pressure.

8. The assembly according to claim 6, further comprising:

an inlet orifice provided on said second compartment;

a second valve provided on a first end of said second container, said second valve configured to move between a closed position and an open position, said second valve configured such that when said second valve is in said open position, said second valve is in leaktight communication with said second compartment via said inlet orifice, so as to allow passage of propellant gas from said second container into said second compartment of said first container; and an exit channel connected to said second valve, said exit channel configured so as to allow said inlet orifice to communicate with an outside of said assembly when said second valve is in said closed position, so as to thereby place said second compartment substantially at atmospheric pressure.

9. The assembly according to claim 7, further comprising a coupling element provided on said exit channel configured to produce leaktight communication between said second valve and said inlet orifice when a pressure is exerted on a second end of said second container, opposite the said second valve, said coupling element configured to release said leaktight communication when the second valve moves said closed position, wherein said second valve includes an elastic return configured to bias said second valve towards said closed position.

10. The assembly according to claim 8, further comprising a coupling element provided on said exit channel configured to produce leaktight communication between said second valve and said inlet orifice when a pressure is exerted on a second end of said second container, opposite the said second valve, said coupling element configured to release said leaktight communication when the second valve moves to said closed position, wherein said second valve includes an elastic return configured to bias said second valve towards said closed position.

11. The assembly according to claim 7, further comprising holding means for holding said second container at a predetermined position with respect to said first container, wherein said inlet orifice is provided in a bottom of the first container.

12. The assembly according to claim 8, further comprising holding means for holding said second container at a predetermined position with respect to said first container, wherein said inlet orifice is provided in a bottom of the first container.

13. The assembly according to claim 9, further comprising holding means for holding said second container at a predetermined position with respect to said first container, wherein said inlet orifice is provided in a bottom of the first container.

14. The assembly according to claim 10, further comprising holding means for holding said second container at a predetermined position with respect to said first container, wherein said inlet orifice is provided in a bottom of the first container.

15. The assembly according to claim 11, wherein said holding means comprises a sleeve connected with said first container, said sleeve having a first end located opposite said second end said second container, said first end of said sleeve being at least partially open, said second container being mounted slidably inside said sleeve over a path which is at least equal to an actuation height of said second valve.

16. The assembly according to claim 15, wherein said sleeve is connected with said first container by at least one of self-locking fitting, snap-fitting, adhesive bonding and welding.

17. The assembly according to claim 1, wherein said first valve is configured to move into said open position when a pressure inside said first compartment, through the action of the propellent gas, reaches a predetermined value, and wherein said first valve is configured to move into the closed position, through the action of elastic return means, when the pressure inside said first compartment drops below said predetermined value.

18. The assembly according to claim 17, wherein said first valve is a ball-type valve.

19. The assembly according to claim 5, wherein said second container is at least one of removable and refillable with propellent gas.

20. The assembly according to claim 5, wherein said second container comprises:

a base; and a body forming a valve-support dish for said second valve, said body interacting with said base to form a reservoir for the propellent gas and to form a valve body for said second valve.

* * * * *